United States Patent [19]

Yamaguchi et al.

[11] Patent Number: 4,936,185

[45] Date of Patent: Jun. 26, 1990

[54] ELECTRONIC MUSICAL INSTRUMENT HAVING PLURAL COMPONENT BLOCKS

[75] Inventors: Yorihisa Yamaguchi; Hiroyuki Kawai; Fujiyo Mandai; Naoya Tetsumura, all of Hamamatsu, Japan

[73] Assignee: Yamaha Corporation, Shizuoka, Japan

[21] Appl. No.: 136,818

[22] Filed: Dec. 22, 1987

[30] Foreign Application Priority Data

Dec. 25, 1986 [JP] Japan ..... 61-313713
Feb. 6, 1987 [JP] Japan ..... 62-26982

[51] Int. Cl.[5] ..... G10H 5/00; G10H 1/32; G10H 1/00

[52] U.S. Cl. ..... 84/670; 84/644; 84/647; 84/653; 84/659; 446/91; 446/397; 446/408; 200/52 R

[58] Field of Search ..... 84/1.01, DIG. 3, DIG. 7, 84/94.1, 94.2, 95.1, 95.2, 1.03, 1.22, 1.19, 1.27; 446/91, 397, 408, 484; 434/224, 340

[56] References Cited

U.S. PATENT DOCUMENTS

| | | | |
|---|---|---|---|
| 3,335,629 | 8/1967 | Brodin | 84/1.01 X |
| 3,447,249 | 6/1969 | Greger | 446/91 |
| 3,470,785 | 10/1969 | Shallenberger et al. | 84/478 X |
| 3,478,159 | 11/1969 | Olson | 84/470 X |
| 3,817,144 | 6/1974 | Okamoto | 84/470 |
| 3,982,463 | 9/1976 | Waters, Jr. | 84/470 X |
| 4,352,310 | 10/1982 | Orlandoni | 84/1.01 |
| 4,506,587 | 3/1985 | Tanaka | 84/477 R X |
| 4,651,613 | 3/1987 | Harrison | 84/95.2 |
| 4,711,148 | 12/1987 | Takeda et al. | 84/1.01 |
| 4,836,075 | 6/1989 | Armstrong | 84/95.2 X |

FOREIGN PATENT DOCUMENTS

| | | | |
|---|---|---|---|
| 0739627 | 6/1980 | U.S.S.R. | 434/340 |

*Primary Examiner*—R. L. Moses
*Assistant Examiner*—Matthew S. Smith
*Attorney, Agent, or Firm*—Koda & Androlia

[57] ABSTRACT

An electronic musical instrument comprises a plural number of component blocks capable of being coupled mechanically and electrically in succession and each having therein musical tone elements control means and at least one of the blocks having also musical tone signal generating means. Time range or tonal range of generated musical tones are changed according to how many blocks are connected consecutively in a predetermined or a selected order. The blocks can generate a series of musical tones in a sequence corresponding to a connecting sequence when a switch arranged on the leading block is operated, and a desired musical piece can be performed by operating performance operating means of each block. The electric musical instrument also can be used as an educational toy allowing infants to learn music while amusing and is convenient for transportation since it can be easily dismembered into each block.

16 Claims, 6 Drawing Sheets

ELECTRONIC MUSICAL INSTRUMENT HAVING PLURAL COMPONENT BLOCKS

Background of the invention (a) Field of the invention:

The present invention relates to an electronic musical instrument having plural component blocks which are mechanically and electrically connected to constitute an entire instrument.

(b) Description of the prior art:

The conventionally known electronic musical instruments, for example, the one disclosed by Japanese Utility Model Preliminary Publication No. 60-122991, comprises a keyboard consisting of plural keys covering a preliminarily determined tone range as pitch designating manipulators and a time signal generating means for generating a tone signal of the pitch corresponding to a key operated on said keyboard. However, the conventional electronic musical instrument limits its performable tone range by the number of keys thereof and poses a problem that the performable tone range is insufficient for certain music pieces, especially in case of a small keyboard type of electronic musical instrument. This problem can be solved by increasing the number of keys, but such a solution will pose another problem that an electronic musical instrument having a large number of keys will be relatively large in its dimensions and inconvenient for transportation.

Further, as a prior art more or less related to the present invention, Japanese Patent Preliminary Publication No. Sho 54-105515 disclosed an electronic musical instrument incorporating a device permitting a performer to preliminarily designate pitches of tones to be generated by consecutively operating a plural number of manipulators in the sequence of generation and allowing the electronic musical instrument to generate the designated pitches of tones in the due sequence. However, the conventional electronic musical instrument requires tedious operating procedures, has no high amusing property, and is therefore unsuited for infants, for example, to learn music while amusing.

Summary of the invention

In view of the above problems, a primary object of the present invention is to provide an electronic musical instrument comprising plural component blocks and having a tone range changed by the number of the connected component blocks.

Another object of the present invention is to provide an electronic musical instrument comprising plural component blocks and having a function of an educational toy allowing infants, for example, to learn music while amusing.

According to the present invention, these objects can be accomplished by composing the electronic musical instrument of at least three blocks mechanically and electrically connectable to one another, each having a musical tone elements control means and at least one of said blocks having also a tone signal generating means, and connecting these blocks consecutively to change time range or tonal range of tones.

In a preferred formation of the electronic musical instrument according to the present invention, each of the consoles designed as said blocks is equipped with a first connector and second connector allowing connection to the other consoles, a tone signal generating means for generating tone signals, an operating switch for activating the tone signal generating means to generate tone signals, an input means arranged on the first connector for inputting a signal for activating the tone signal generating means to generate tone signals, and an output means arranged on the second connector for outputting a signal indicating end of the tone signal generation by the tone signal generating means.

In this formation, when a plural number of the consoles are connected by the first and second connectors and the operating switch arranged on the leading console is operated, the tone signal generating means in the console is activated and tone signals are generated. Upon termination of the tone signal generation, a signal indicating the termination is outputted from the output means and sent to the input means in the next console for activating the tone signal generating means in the next console to generate tone signals. Since the consoles generated a series of tone signals in a sequence corresponding to a connecting sequence simply by connecting a plural number of consoles and operating the switch arranged on the leading console, infants, for example, can enjoy generation of tone signals in a sequence corresponding to a connecting sequence and learn music at ease while connecting the consoles is various sequences. Further, it is possible to amuse himself while generating tones appropriately with a single console.

In another preferred formation of the present invention, the plural number of blocks are a musical instrument main unit for generating note signals and a plural number of performance operating units having plural pitch operators and serially connectable to the musical instrument main unit in sequence; said musical instrument main unit consisting of a first output means for outputting position detecting signals for detecting the connected positions, on the musical instrument main unit, of the performance operating units serially connected to said musical instrument main unit, a first input means for inputting signals indicating an operated pitch designating manipulator and connected position on the musical instrument main unit of the performance operating unit having said pitch designating operator from the performance manipulator unit, and a note signal generating means for generating, on the basis of the signal inputted through said first input means, a note signal of the pitch corresponding to the pitch designating manipulator and the connected position indicated by said signal, whereas each performance operating unit consisting of a second input means for inputting the position detecting signal outputted from the side of the musical instrument main unit, a position detecting means for detecting the connected position, on the musical instrument main unit, of the performance operating unit on the basis of the position detecting signal inputted through the second input means, a second output means for outputting the connected positions, on the musical instrument main unit, of the performance operating units connected at the subsequent stages on the basis of the position detecting signals inputted through the second input means, a manipulator detecting means for detecting the operation of the pitch designating manipulator a third input means for inputting signals indicating the pitch designating manipulator operated by the performance operating unit connected at the next stage and the connected position, on the musical instrument main unit, of the performance operating unit having said pitch designating manipulator, and a third output means for outputting the signals indicating the connected position detected by the position detecting means and the pitch designating manipulator detected by the operator detecting means together with the third detecting means to the musical instrument main unit.

In a third formation of the electronic musical instrument according to the present invention, when a position detecting signal for detecting the connected position, on the musical instrument main unit of, a performance operating unit is outputted from the first output means of the musical instrument main unit in a condition where a plural number of performance operating units are connected to the musical instrument main unit, the position detecting signal is transferred consecutively to the performance operating units through the second input means and the second output means of each performance operating units. In each performance operating unit, on the other hand, the position detecting means detects the connected position on the musical instrument main unit on the basis of the position detecting signal and the manipulator detecting means detects the operation of the pitch designating manipulator. The detected connected position and the signal indicating the detected operation of the pitch designating manipulator are transferred to the musical instrument main unit through the third and input means and the third output means of each performance operating unit. In the musical instrument main unit, the transferred signals are fed to the tone signal generating means through the first input means, and the tone signal generating means generates a note signal of the pitch corresponding to the operated pitch designating manipulator and the connected position on the musical instrument main unit of the performance operating unit having said operator on the basis of said fed signals.

Since the tone signal generating means generates a note signal of the pitch corresponding to the pitch designating manipulator operated in each performance operating unit and the connected position, on the musical instrument main unit, of the performance operating unit having said operator, the third formation described above makes it possible to compose an electronic musical instrument covering a desired tone range by connecting the performance operating units consecutively to the musical instrument main unit, and always obtain a sufficient tone range. Further, since the musical instrument main unit and each performance operating unit can be designed as small consoles, the electronic musical instrument can easily be transported when the performance operating units are disconnected from the musical instrument main unit.

These and other objects as well as the features and advantages of the present invention will become apparent from the following detailed description of the preferred embodiments when taken in conjunction with the accompanying drawings.

Description of the preferred embodiments

Figure 1:
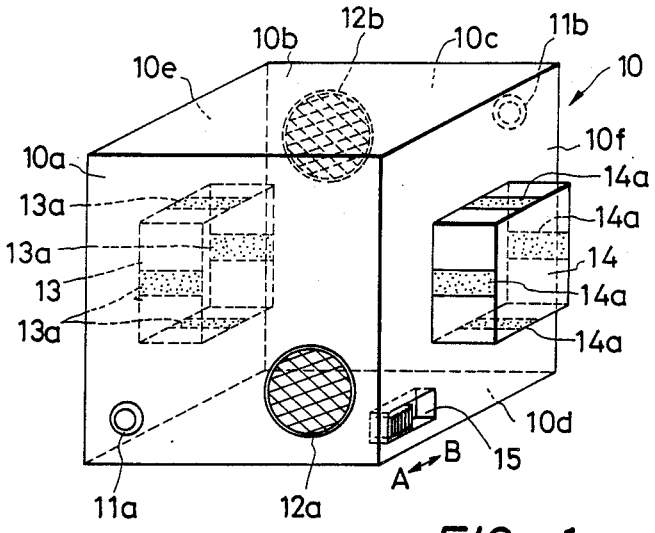
FIG. 1 is a view illustrating an external appearance of a console used in an embodiment of the electronic musical instrument according to the present invention.
Figure 2A:
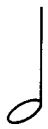
FIGS. 2A through 2D are sketches illustrating the note signs sketched on the console shown in FIG. 1.
Figure 2B:
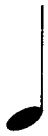
Figure 2C:
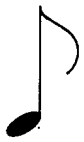
Figure 2D:
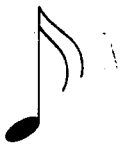
Figure 4:
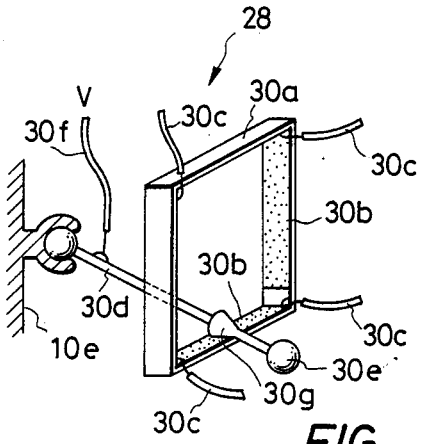
FIG. 4 is a sketch illustrating the direction detector shown in FIG. 3.
Figure 3:
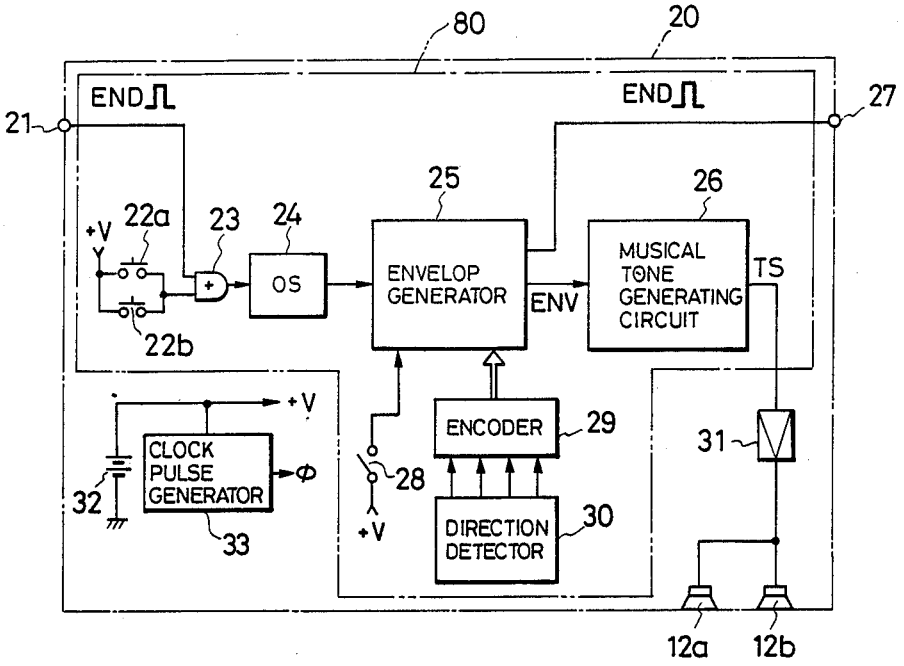
FIG. 3 is a block diagram illustrating the electric circuit comprised in the console shown in FIG. 1.

Now, Embodiment 1 of the electronic musical instrument according to the present invention will be described with reference to FIGS. 1 through 4. The console 10, a block of the electronic musical instrument, is designed as a cubic unit having a front surface 10*a*, top surface 10*b*, rear surface 10*c*, bottom surface 10*d*, left side surface 10*e* and right side surface 10*f*. The console 10 is made of a material such as a plastic or wood, its entire surfaces are painted in a color representing the pitch to be issued from the console 10, for example, red corresponding to "Do" or green corresponding to "Re", and characters representing pitch, for example, "Do" or "Re" are marked on the surfaces 10*a* through 10*f*. Further, the half note, quarter note, eighth note and sixteenth note shown in FIGS. 2A through 2D are marked on the front surface 10*a*, top surface 10*b*, rear surface 10*c* and bottom surface 10*d* respectively. These signs represent durations of the tone to be issued from the console 10, and the duration is corresponding to the sign marked on a surface (any one of the surfaces 10*a* through 10*d*) which is set atop by turning the console 10 around an axis of the line passing through the right and left side surfaces 10*e* and 10*f*. Embedded in the front surface 10*a* and rear surface 10*c* are manipulator 11*a* and 11*b* to be depressed by hand for commanding start of tone issuance as well as loudspeakers 12*a* and 12*b*. Therefore, the manipulator 11*a* and loudspeaker 12*a* (or the manipulator 11*b* and loudspeaker 12*b*) are always located on a surface which is not set on the bottom even when the console 10 is turned as described above. Formed in the left side surface 10*e* is a fitting concavity 13 in a form of a rectangular parallelopiped equipped with electrodes 13*a* arranged on the side surfaces thereof. Formed in the right side surface 10*f* is a fitting convexity 14 in a form of rectangular parallelopiped for fitting into the fitting concavity 13 of the console 10 used as another block, and arranged on the four side surfaces of the convexity 14 electrodes 14*a* to be electrically connected to the electrodes 13*a* of the other console 10 when the convexity is fitted. Further, embedded in the right side surface 10*f* is a slidable type of manipulator 15 which is slid by hand from the position A to the position B shown in FIG. 1 for changing said half note, quarter note, eighth note and sixteenth note into dotted noted respectively. Moreover, the console 10 comprises an electric circuit module 20 shown in FIG. 3. The electric circuit device 20 is equipped with an input terminal 21 connected to the electrode 13*a* (FIG. 1), and self-resetting type of normally open switches 22*a* and 22*b* which are closed for outputting in parallel a voltage of +V upon depression of the operators 11*a* and 11*b* (FIG. 1) respectively. These input terminal 21 and switches 22*a* and 22*b* are connected to an input terminal of an OR circuit 23, and an output terminal of the OR circuit is connected to an envelope generator 25 by way of a one-shot multivibrator circuit 24. Upon receiving pulse signals from the one-shot multivibrator circuit 24, the envelope generator 25 feeds an envelope waveform signal ENV representing an envelope of a musical tone to a musical tone generating circuit 26 and an end pulse signal END representing end of generation of the signal ENV to an output terminal 27 connected to the electrode 14*a* (FIG. 1). The generating duration of the envelope waveform signal ENV (corresponding to the tone duration) is controlled by the signals from the switch 28 and encoder 29. The switch 28 is opened when the manipulator 15 is set at the position A shown in FIG. 1 and closed to supply the voltage +V to the envelope generator 25 when the manipulator 15 is slid to the position B shown in FIG. 1. A direction detector 30 is connected to the encoder 29. The direction detector 30 is fixed in the console 10 in a direction parallel to the left and right side surfaces 10*e* and 10*f*, and equipped with a square frame 30*a* made of an insulating material such as plastic. Bonded to the inside of the sides of the frame 30*a* are conductive plates 30*b* is mutually isolated condition. Lead wires 30*c* are connected to these conductive plates 30*b* and led to the encoder 29. In addition, the direction detector 30 is equipped with a direction sensor rod 30*d* made of a conductive material. One end of the direction sensor rod 30*d* is supported with a ball joint inside the left side surface 10*e* of the console 10, whereas the other end of the direction sensor rod 30*a* passes through the frame 30*a* and is fixed to a weight 30*e*, whereby the rod 30*d* falls on the inside of each side of the frame 30*a* in conjunction with rotation of the console 10. Further, connected to the direction sensor rod 30*d* is a lead wire 30*f* energized by the voltage +V to supply the voltage to any one of the lead wires 30*c* through a conical contact portion 30*g* formed in the course of the rod 30*d* and the conductive plate 30*b*. Accordingly, signals corresponding to the above-described rotation of the console 10 is supplied to the encoder 29. The musical tone generating circuit 26 generates a tone signal of the pitch corresponding to the color painted over the entire surfaces of the console 10 and represented by the characters on the surfaces 10*a* through 10*f*. Upon generation of the envelope waveform signal ENV from the envelope generator 25, the circuit 26 generates a tone signal ST having an amplitude controlled by the envelope waveform signal ENV and supplies the tone signal TS to the loudspeaker 12*a* or 12*b* through an amplifier 31. Furthermore, the electric circuit 20 is equipped with a battery 32 and a clock pulse generator 33; the battery 32 supplies a power source voltage of +V to each circuit, whereas the clock pulse generator feeds a clock signal $\phi$ to each circuit.

Figure 5:
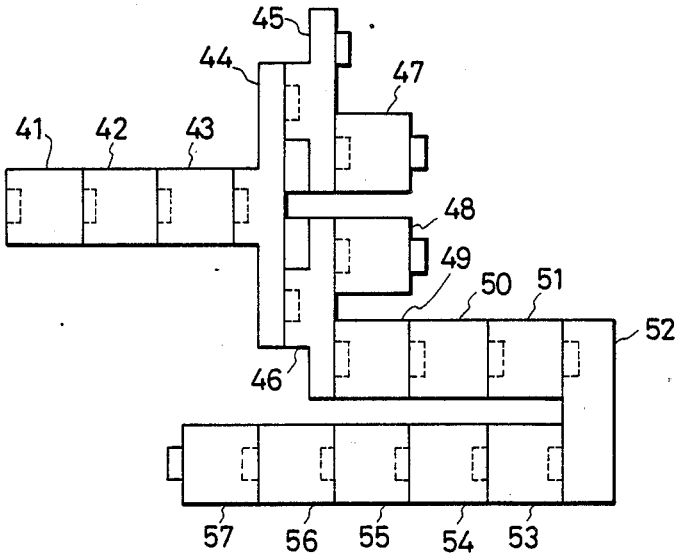
FIG. 5 is a diagram illustrating the connected condition of the console shown in FIG. 1.

The functions of this embodiment will be described below together with the operating procedures:

In the first place, the console 10 is prepared in a plural number and the consoles corresponding to the tones of the pitches to be issued are selected one by one referring to the colors painted on the consoles or the characters marked on the surfaces 10*a* through 10*f*. Then, the consoles 10 are turned around the axis of the line perpendicularly intersecting with the left and right surfaces 10*d* and 10*e* until the note signs (FIGS. 2A through 2D) of the tones to be issued are set atop, and the operator 15 is slid to the position B shown in FIG. 1 when the dotted signs are desired or set at the position A shown in FIG. 1 when the dotted notes are not desired. The consoles 10 are connected in succession by fitting the convexities 14 into the concavities 13. A connected condition of the consoles 10 is exemplified in FIG. 5 wherein the reference numerals 41 through 43, 47 through 51 and 53 through 57 represent the consoles 10. The reference numerals 44 through 46 designate branching connectors for branching the connections of the consoles 10. The connectors 44 through 46 are equipped on one side thereof with a fitting concavity in the form similar to the fitting concavity 13, on the opposite side thereof with two fitting convexities in the form similar to the fitting convexity 14 and in the inside thereof with electrical wiring for feeding the signal supplied to the one fitting concavity parallel with to the two fitting convexities. Therefore, the signal (end pulse signal END) outputted from the console 43 is supplied simultaneously to the consoles 47 through 49. The reference numeral 52 denotes a fold-back connector for folding back the arrangement of the consoles 10. The connector 52 is equipped on one side with a fitting concavity and a fitting convexity similar to the fitting concavity 13 are fitting convexity 14 respectively, and inside with an electrical wiring for outputting the signal supplied to the fitting concavity directly to the fitting convexity. Therefore, a multiple number of the consoles 10 can be connected even within a narrow space. When the manipulator 11*a* (or 11*b*) is depressed on the console 41 in such a connected condition, the switch 22*a* (or 22*b*) is closed, and a pulse signal is supplied to the envelope generator 25 by way of the OR circuit 23 and one-shot multivibrator circuit 24. In conjunction with the signal supplied through the encoder 29 from the direction detector 30 for detecting rotational position of the console 41 and condition of the switch 28, the envelope generator 25 generates an envelope waveform signal ENV corresponding to the note marked on the surface set atop (any one of the surfaces 10*a* through 10*d*) of the console 41 and determined by the manipulator 15 whether or not to be dotted. Upon the generation of this envelope waveform signal ENV, it is fed to the tone forming circuit 26 and the console 41 generates a tone signal TS having the pitch peculiar to the console or corresponding to the color painted on the surface (or the characters marked on the surfaces 10*a* through 11*f*). This tone signal TS is supplied to the loudspeaker 12*a* or 12*b* through the amplifier 31 and the loudspeaker 12*a* or 12*b* issues a tone corresponding to the tone signal TS. Upon termination of issuance of this tone, the envelope generator 25 outputs the end pulse signal END and supplies it to the output terminal 27.

The end pulse signal END is supplied to the input terminal 21 of the console 42. In the console 42, the end pulse signal END is supplied to the envelope generator 25 by way of the OR circuit 23 and one-shot multivibrator circuit 42, whereby the console 42 issues a tone in the same processes as those in the console 41. Upon termination of tone issuance from the console 42, the console 43 issues a tone. Upon termination of tone issuance from this console, the end pulse signal END outputted from the output terminal 27 of the console 43 is supplied simultaneously to the input terminals 21 of the consoles 47 through 49 by way of the branching connectors 44 through 46, thereby allowing the consoles 47 through 49 to issue tones at the same time. Therefore, it is possible to simultaneously issue a plural number of tones corresponding to a chord. Upon termination of the tone issuance from the console 49, the consoles 50, 51 and 52 issue tones in sequence.

As is understood from the above functional description, the Embodiment 1 of the present invention makes it possible to connect a plural number of the consoles 10 in an optional sequence so as to issue tones in a sequence corresponding to the connected condition, thereby allowing infants, etc. to connect the consoles referring to a score or at option and learn music while enjoying series of tones issued in various connected conditions or amusing themselves.

Figure 6:
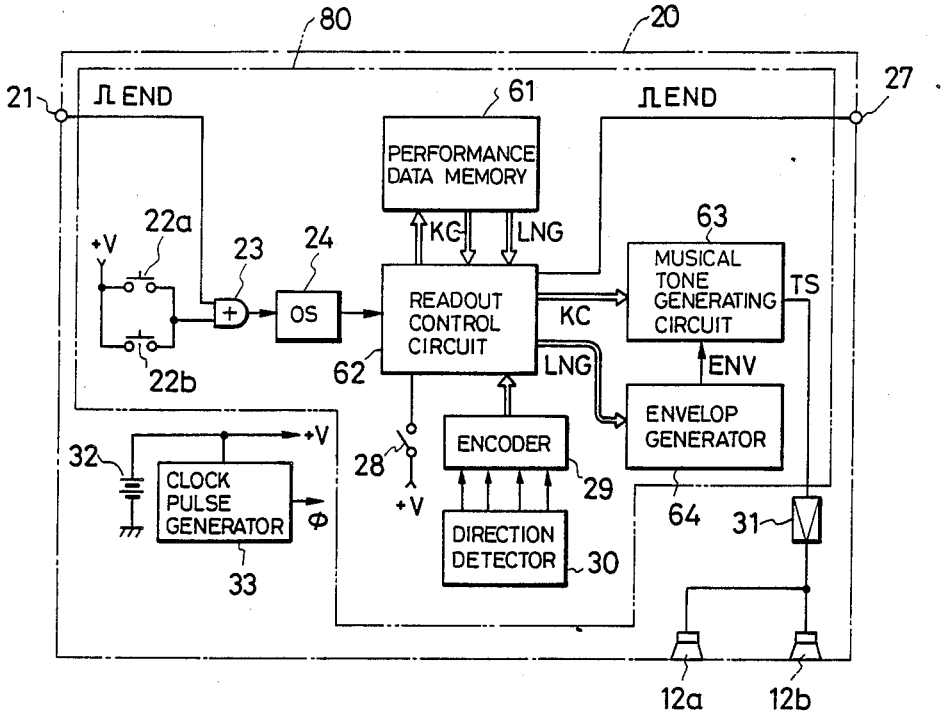
FIG. 6 is a block diagram illustrating the electric circuit comprised in the console in another embodiment of the present invention.

Now, description will be made on Embodiment 2 of the present invention wherein each of the consoles 10 is so adapted as to issue a series of tones corresponding to a single measure or two measures. The electronic musical instrument as the Embodiment 2 has a formation similar to that of the Embodiment 1, except for the front surface 10*a*, top surface 10*b*, rear surface 10*c* and bottom surface 10*d* of the console 10 on each of which a note row representing a series of tones to be issued is sketched and the electric circuit device which has a little different composition. In the Embodiment 2, the electric circuit module 20 is equipped with a performance data memory 61 storing a plural sets of data rows consisting of pitch data KC and duration data LNG representing pitches and durations of plural tones corresponding to a series of tones rows as shown in FIG. 6. Connected to this performance data memory 61 is a readout control circuit 62 which reads out, upon receiving an output signal from the one-shot multivibrator circuit 24, the pitch data KC and duration data LNG to be utilized for generating a single tone consecutively from the performance data memory upon every lapse of the time corresponding to the duration data LNG. In this case, the switch 28 and direction detector, 30 function to designate a data set from which a data row is to be read out. The readout pitch data KC and duration data LNG are fed to the tone generating circuit 63 and generator 64 respectively. The tone generating circuit 63 generates a tone output of the pitch represented by the pitch data KC. The envelope generator 64 outputs an envelope waveform signal ENV having the duration corresponding to the duration data LNG to the tone generating circuit 63 for controlling the amplitude envelope of the tone signal TS to be outputted from the circuit 63. Further, upon termination of issuance of a series of tone signals, the tone generating circuit outputs to the output terminal 27 an end pulse signal END representing termination of the tone issuance. The other electrical circuits are quite the same as those used in the Embodiment 1.

When a plural number of the consoles 10 are connected in the manner similar to that in the Embodiment 1 and the manipulator 11*a* (or 11*b*) is operated on the leading console 10 in the Embodiment 2, each console 10 issues a series of tones corresponding to a single measure or two measures in succession. Therefore, tones corresponding to a musical piece can be generated by connecting the consoles 10 in a small number and the Embodiment 2 is suited for utilization for guessing names of musical pieces, musical composition and so on.

Though pitches are represented by colors and characters, and durations are indicated by the note signs in the Embodiment 1, pitches can be represented by the positions on the staff and durations can be indicated by lengths of the consoles 10 or the similar means. In addition, though each of the consoles 10 is so designed as to issue a specific pitch of tone, it is possible to design the tone generating circuit 26 so as to permit varying tone pitch and arrange a pitch designating manipulator on the console 10. Such a design will be effective to minimize number of the consoles 10 to be prepared in practice. It is also possible to equip the console 10 with an manipulator for switching duration in place of the direction detector 30. This manipulator is applicable also to the Embodiment 2 and, in case of such application, types of the data rows will be switched by use of the manipulator.

Figure 7:
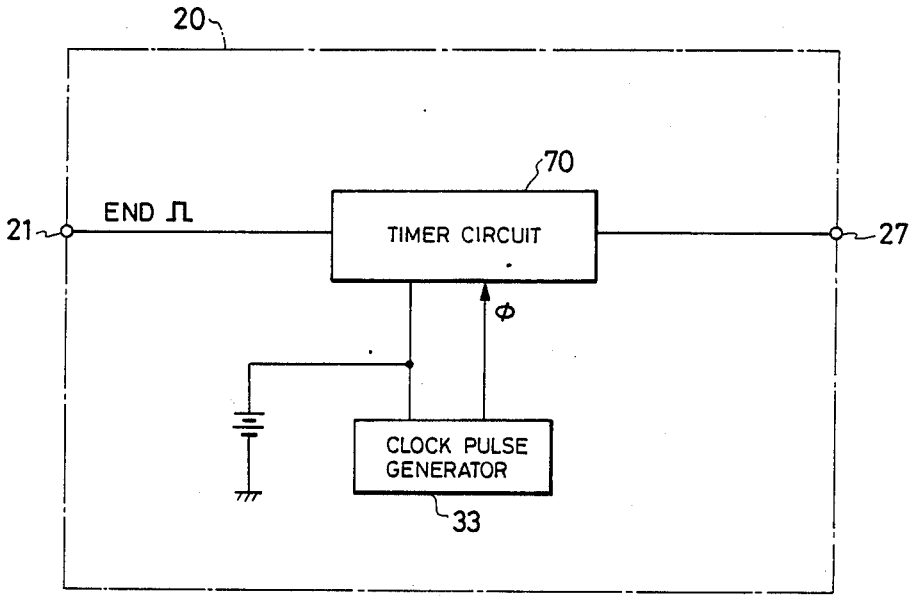
FIG. 7 is a block diagram illustrating the electric circuit comprised in the console for rest.
Figure 8:
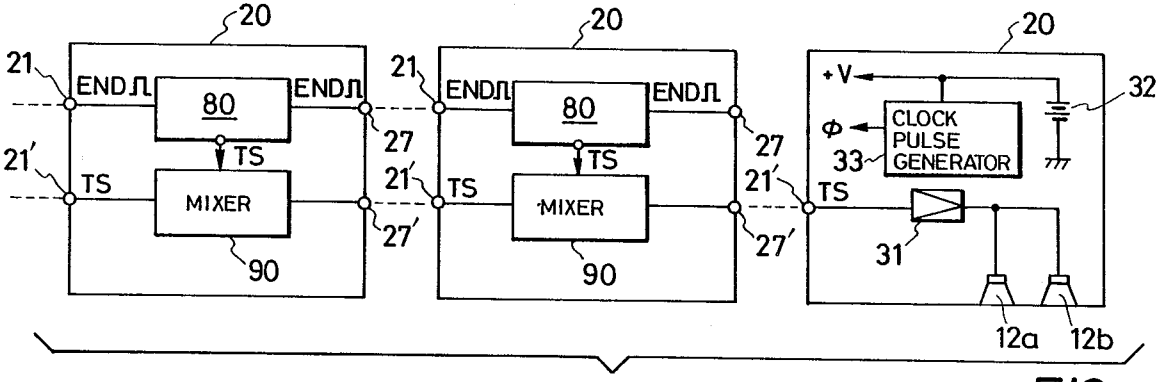
FIG. 8 is a block diagram illustrating the electric circuit comprised in the console in a third embodiment of the present invention.

Furthermore, though tones are generated always in the same color in the Embodiments 1 and 2 described above, it is possible to equip the consoles 10 with color designating or design the consoles 10 so as to generate tones of different colors. In addition, the Embodiment 1 can incorporate a console for rest to reserve a rest in the course of tone generation. In such a case, the electric circuit module 20 comprised in the console for rest should be composed of a timer circuit 70 as shown in FIG. 7. Moreover, though each console 10 is equipped with loudspeakers 12*a* and 12*b* in the Embodiment 1 and 2 described above, the loudspeakers 12*a* and 12*b* can be omitted by inputting the tone signal TS from the console 10 at the preceding stage to the electric circuit module 20 in each console 10 through the input terminal 21 as shown in FIG. 8, adopting a mixer 90 for mixing the tone signal TS with the tone signal TS outputted from the tone generating circuit portion 80 (enclosed by the double-dot chain lines in FIG. 3 and FIG. 6) and transferring the mixed signal to the consoles 10 at the subsequent stages through an output terminal 27', and connecting a console having only the amplifier 31, loudspeaker 12*a* and 12*b* at the final stage. Further, the batteries 32 and clock pulse generators 33 can be omitted from the consoles but one by arranging the battery 33 and clock pulse generator 33 only in the console at the final or leading stage, and transferring the voltage $+V$ from the battery 32 and the clock signal $\phi$ from the clock pulse generator 33 to each of the connected consoles 10. In this case, since a common clock signal $\phi$ is fed to each of the consoles 10, it is possible to modify performance tempo and uniformalize pitches of the tones to be produced by varying frequency of the clock signal $\phi$. The console 10 may have a form other than the cubic or rectangular parallelopiped form.

Figure 9:
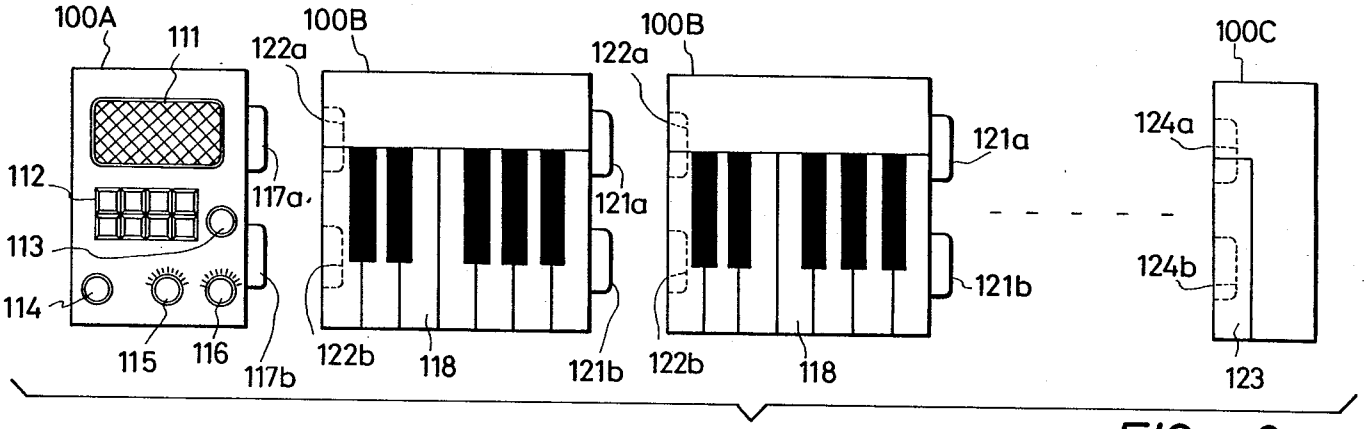
FIG. 9 shows sketches illustrating external appearances of three types of consoles in a fourth embodiment of the present invention.
Figure 10:
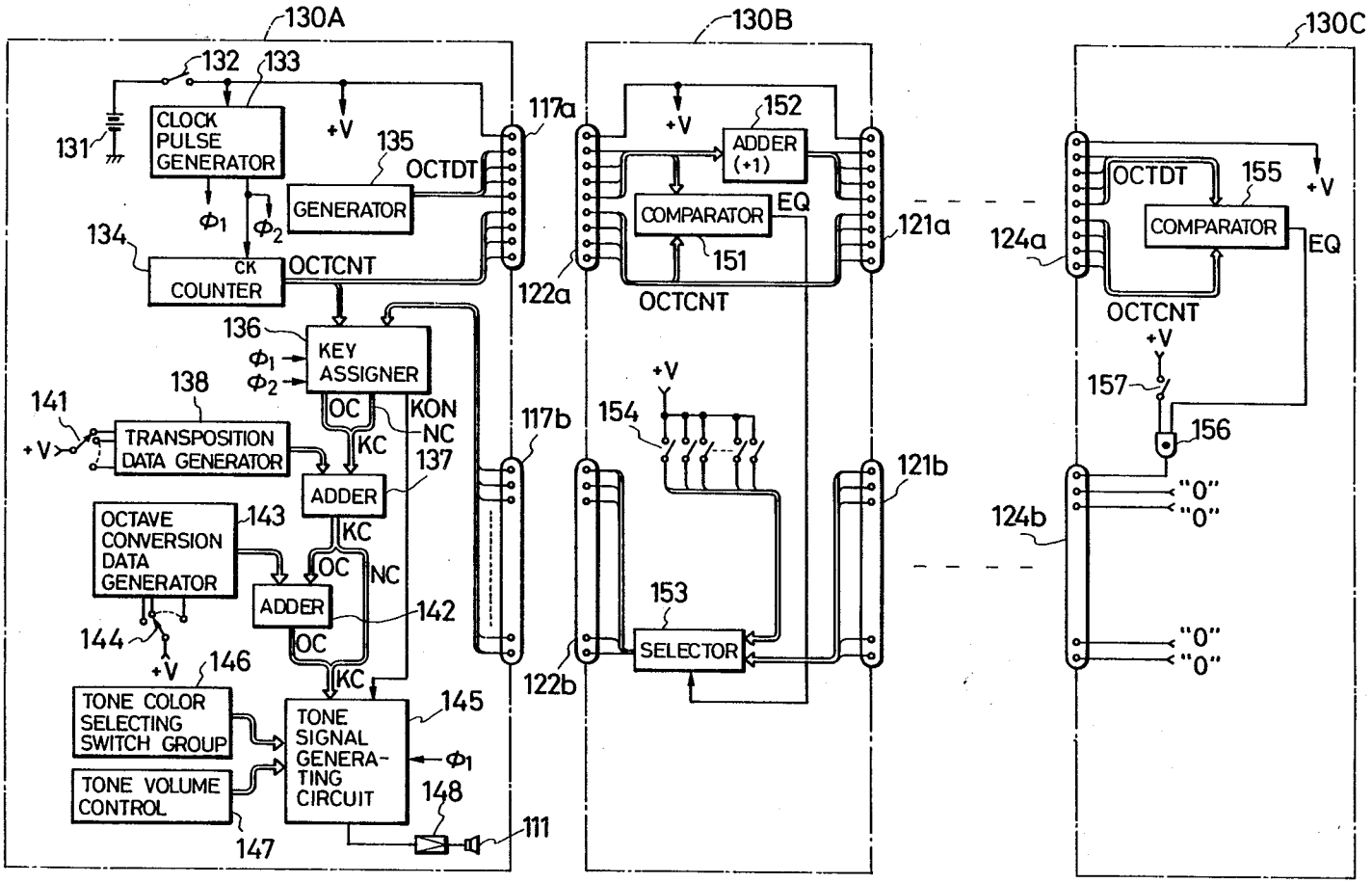
FIG. 10 shows block diagrams illustrating the electric circuits comprised in the three types of console shown in FIG. 9.

Now, a third embodiment of the present invention will be described with reference to FIGS. 9 and 10. In this embodiment, the electronic musical instrument comprises a musical instrument main unit 100A as a block for issuing tones, a plural number of performance operating units 100B, 100B, . . . as blocks sequentially connectable and a performance operating unit 100C as a block to be connected at the final stage. The musical instrument main unit 100A is designed as a rectangular parallelopiped console equipped on its top surface with a loudspeaker 111, a color selecting manipulator 112 for selecting a color of musical tones to be produced, a power manipulator 113 for turning on and off power, a tone volume manipulator 114 for controlling volume of tones to be produced, a transposing manipulator 115 for enhancing and lowering pitch of tones to be produced at intervals of 100 cents and an octave switching manipulator 116 for enhancing and lowering pitch a intervals of 1 octave (1200 cents). Further, the musical instrument main unit 100A is equipped on its right side surface with connectors 117*a* and 117*b* permitting mechanical and electrical connections to the performance operating units 100B, 100B, . . . and 100C. Each of the performance operating units 100B, 100B, . . . is designed as a rectangular parallelopiped unit equipped on its top surface with white and black keys 118 for 1 octave ranging from the C-tone to B-tone. Each of the performance operating units 100B, 100B, . . . is equipped on its right side with connectors 121*a* and 121*b* which have the composition similar to that of the connectors 117*a* and 117*b*, and permitting mechanical and electrical connections to the performance operating units 100B, 100B, . . . and 100C. Arranged on the left side surface of each performance operating unit 100B are connectors 122*a* and 122*b* connectable to the connectors 117*a* and 117*b* of the musical instrument main unit 100A and the connectors 121*a* and 121*b* of the performance operating units 100B, 100B, . . . . The performance operating unit 100C is designed as a rectangular parellelopiped unit equipped on its top surface with a key corresponding to the C-tone. Arranged on the left side surface of the performance operating unit 100C are connectors 124*a* and 124*b* which are composed similarly to the connectors 122*a* and 122*b*, and connectable to the connectors 117*a* and 117*b* of the musical instrument main unit and connectors 121*a* and 121*b* of the performance operating units 100B, 100B, . . . . Moreover, the musical instrument main unit 100A, performance operating units 100B, 100B, . . . and performance operating unit 100C comprise electric circuit modules 130A, 130B and 130C respectively shown in FIG. 10. The electric circuit module 130A includes a power source 131 which is connected to the connector 117*a* by way of a power switch 132 to be turned on and off with a power manipulator 113, connected to each of the circuits such as a clock pulse generator 133 arranged on the electric circuit module 130A and supplies a voltage of +V to the connector 117*a* and each circuit when the power switch is turned on. The clock pulse generator 133 generates a first clock signal $\phi_1$ at a high rate and a second clock signal $\phi_2$ at a low rate. The second clock signal $\phi_2$ is fed to a counter 134. The counter counts the second clock signal $\phi_2$ and outputs to the connector 117*a* octave count data OCTCNT varying repeatedly from "0" to "15". The sequentially varying octave count data OCTCNT correspond to the first to sixteenth octaves of the tones to be produced, and represent connected positions, on the musical instrument main unit, of the performance operating units 100B, 100B, . . . and 100C. Connected to the connector 117*a* is a data generator 135 which outputs octave data OCTDT representing the first octave ("0" in this embodiment). In addition, "1" is added to the octave data OCTDT in the performance operating units 100B, 100B, . . . and 100C as described later, and the octave data OCTDT is used for detecting the connected positions, on the musical instrument main unit, of the performance operating units 100B, 100B, . . . and 100C. A key assigner 136 is connected to the counter 134. The key assigner 136 inputs the octave count data OCTCNT, inputs signals representing operated conditions of the keys 118 and 123 on the performance operating units 100B, 100B, . . . and 100C fed through the connector 117*b* (signals representing connected positions, on the musical instrument main unit, of the performance operating units 100B, 100B, . . . and 100C as positions on a time axis, and indicating keys 118 and 123 as bit positions as described later), detects octave (connected positions, on the musical instrument main unit, of the performance operating units 100B, 100B, . . . and 100C) and notes (keys 118 and 123) of the keys depressed on the performance operating units 100B, 100B, . . . and 100C, executes an assigning processing for assigning the keys to some of the plural tone generating channels in the tone signal generating circuit 145, and outputs to each channel, in a time division mode, a key code KC consisting of an octave code OC representing an octave of the key assigned to each channel and a note code representing the note of the key in addition to a key-on signal KON indicating the depressed condition of the key. Said assigning processing is executed in synchronization with the first and second clock signals $\phi_1$ and $\phi_2$ supplied from the clock pulse generator 133. Connected to the output side of the key assigner 136 is an adder 137 which outputs the key code KC after transposition by adding the key code KC from the key assigner 136 to the transposition data from a transposition data generator 138. The transposition data generator 138 stores transposition data for enhancing or lowering, at a definite rate and in the note unit, the key code KC supplied from the key assigner 136, and outputs the data in conjunction with the output from a rotary switch manipulated with the transposition manipulator 115. Out of the codes included in the key code KC outputted from the adder 137, the octave code OC is fed to an adder 142. The adder 142 adds the octave code OC to the octave conversion data from an octave conversion data generator 143 for octave conversion of the octave code OC and then outputs the converted data. The octave conversion data generator 143 stores the octave conversion data for enhancing or lowering, at a definite rate and in octave unit, the octave code OC from the adder 137, and outputs the converted data in conjunction with the output from a rotary switch 144 manipulated with the octave switching manipulator 116. The key code KC consisting of the note code NC from the adder 137 and the octave code OC from the adder 142, and the key-on signal KON from the key assigner 136 are supplied to a tone signal generating circuit 145. The tone signal generating circuit 145 has a plural number of tone generating channels: a channel to which a depressed key is assigned by the key assigner generates a tone signal of the pitch corresponding to a supplied key code KC and imparts for output an envelope waveform signal generated on the basis of the supplied key-on signal KON to said tone signal. Connected to the tone signal generating circuit 145 are a group of tone color selecting switches 146 and a tone volume control 147. The tone color selecting switches consists of a plural number of switches turned on and off in conjunction with manipulation of a group of the tone color selecting manipulators 112, and color of the tone signal and shape of the envelope waveform signal to be generated by the tone signal generating circuit 145 are determined by open and closed conditions of each switch. The tone volume control 147 operates in conjunction with manipulation of the volume manipulator 114 and controls volume of tone signal to be outputted from the tone signal generating circuit 145. The tone signal and envelope waveform signal are generated in synchronization with the first clock signal $\phi_1$ from the clock pulse generator 133. Connected to the output stage of the tone signal generating circuit 145 is the loudspeaker 111 by way of an amplifier 148. The electric circuit module 130B receives the voltage +V from the connector 117*a* through the connector 122*a*, supplied the voltage to each circuit arranged on the electric circuit module 130B and outputs the voltage +V from the connector 121a. The electric circuit module 130B is equipped further with a comparator 151. The comparator 151 receives as an input the octave data OCTDT through the connector 122a and as the other input the octave count data OCTCNT through the connector 122a. The comparator detects equalization between the octave data OCTDT and octave count data OCTCNT, and outputs an equalization signal EQ. The octave data OCTDT supplied as an input to the comparator 151 is fed to an adder 152, which converts the data OCTDT by adding "1" to the data OCTDT (in this embodiment, the first performance operating unit 100B converts into "1", the second performance operating unit 100B converts into "2", . . . ) and outputs the converted data to the connector 121a. The octave count data OCTCNT supplied as the other input to the comparator 151 is outputted directly to the connector 121a. The equalization signal EQ from the comparator 151 is supplied to a selector 153. The selector 153 receives as an input signals representing operated conditions of the keys 118 on the performance operating unit 100B from key switches 154 corresponding to the plural keys on the performance operating unit 100B and closed by depressing the keys 118. As the other input, the selector receives signals which are fed through the connector 121b and represent operated conditions of the keys 118 and 123 on the performance operating units 100B, . . . and 100C connected at the subsequent stages. The selector 153 outputs signal representing operated conditions of the keys 118 on the performance operating unit 100B when the comparator 151 generates the equalization signal EQ, and provides outputs representing operated conditions of the keys 118 and 123 on the performance operating units 100B, . . . and 100C connected at the subsequent stages while the comparator does not generate the equalization signal EQ. Accordingly, the signals outputted to the connector 122b represent the connected positions on the musical instrument main unit of the performance operating units 100B, 100B, . . . and 100C by the positions on the time axis corresponding to the octave count data OCTCNT, and keys (notes) by the bit positions. The electric circuit module 130C receives the voltage +V from the connector 121a through the connector 124a and supplies the voltage to each circuit arranged on the electric circuit module 130C. The electric circuit module 130C is equipped further with a comparator 155. The comparator 155 receives as an input the octave data OCTDT through the connector 124a and as the other input the octave count data OCTCNT through the connector 124a. The comparator detects equalization between the octave data OCTDT and octave count data OCTCNT, and provides an equalization signal EQ as an input to an AND circuit 156. As the other input, the AND circuit 156 receives signals from key switches 157 which correspond to the keys 123 on the performance operating unit 100C and are closed by depressing the keys 123. Only when the comparator 155 generates the equalization signal, the AND circuit outputs signals representing operated conditions of the keys 123 to the first terminal of the connector 124b. The other terminals of the connector 124b output signals representing non-operated conditions of the keys.

Functions of the third embodiment having the above described composition will be described below together with its operating procedures.

In the first place, a performer connects the performance operating unit 100B to the musical instrument main unit by connecting the connectors 117a and 117b to the connectors 122a and 122b respectively. Then, by connecting the connectors 121a and 121b to the connectors 122a and 122b respectively in succession, the performer connects the performance operating units 100B to the performance operating unit 100B. After connecting the performance operating units 100B in a desired number, the performer connects the performance operating unit 100C by connecting the connectors 121a and 121b to the connectors 124a and 124b respectively. When the power switch 132 is closed by manipulating the power manipulator 113 after completing the connection, the power source 131 supplies the voltage +V to each circuit arranged on the electric circuit module 130A to start operating the circuit, and the voltage is supplied through the connectors 117a, 122a, 121a, . . . and 124a to each circuit arranged on the electric circuit modules 130B, . . . and 130C to start operating the circuit. When the voltage +V is supplied, the data generator 135 feeds the octave data OCTDT through the connectors 117a and 122a to the electric circuit module 130B in the first performance operating unit 100B. Since the adder 152 adds "1" to the octave data OCTDT and outputs the data to the connector 121a consecutively in the electric circuit modules 130B, octave data OCTDT increasing in "1" steps from "0" are fed to the electric circuit modules 130B, . . . and 130C. On the other hand, the counter 134 feeds the octave count data OCTCNT repeatedly varying in synchronization with the second clock signal $\phi_2$ to each of the electric circuit modules 130B, . . . 130C through the connectors 117a, 122a, 121a, . . . and 124a. Accordingly, the comparators 151, . . . 155 output the equalization signal EQ sequentially and repeatedly in correspondence to the octave count data OCTCNT inputted into the electric circuit modules 130B, . . . and 130C, and at the timing corresponding to the connected positions on the musical instrument main unit of the performance operating units 100B, 100B, . . . and 100C. When the keys 118, 118, . . . and 123 are depressed on the performance operating units 100B, 100B, . . . and 100C in such a condition, the key switches 154, . . . and 157 are closed in the electric circuit modules 130B, . . . and 130C in corresponding to the key depression, and signals representing the operated conditions of the keys 118, 118, . . . 123 are fed into the AND circuit 156. In this case, since the above-described equalization signal EQ is fed to each selector 153 and AND circuit, the signals representing the operated conditions of the keys 118, 118,. . . and 123 are fed to the key assigner 136 through the connectors 117b, 122b, selector 153, connectors 121b, . . . and connector 124b at the time division mode corresponding to the octave count data OCTCNT. Based on the fed signals and the octave count data OCTCNT from the counter 134, the key assigner 136 detects the octaves and notes of the operated keys (the connected positions on the musical instrument main unit 100A of the performance operating units 100B, 100B, . . . and 100C), assigns keys to a plural number of empty tone generating channels, assigns key codes KC related to keys and key-on signal KON, and outputs the codes and signal is synchronization with the channel assignment timing. The outputted key code KC is converted by the address 137 and 142 in conjunction with manipulations of the transposing manipulator 115 and octave switching manipulator 116, and then outputted to the tone signal generating circuit 145. The tone signal forming circuit 145 generates the tone signal represented by the converted key code KC in response to the key-on signal KON from the key assigner 136. Color and volume of the tone signal in this case are controlled by the signals from the color selecting switch group 146 and volume control 147 corresponding to the color selecting manipulator group 112 and volume manipulator 114. The tone signal outputted from the tone signal forming circuit 147 is fed to the loudspeaker 11 through the amplifier 148 and the loudspeaker 111 issues a tone corresponding to the signal.

In the Embodiment 3 described above, since the musical instrument main unit issues the tones of the octaves corresponding to the connected positions, on the musical instrument main unit 100A, of the performance operating units 100B, 100B, . . . and 100C in response to depressions of the keys 118, 118, . . . and 123 on the performance operating units 100B, 100B, . . . and 100C, any music piece can be performed in a sufficient tone range by connecting the performance operating units 100B, 100B, . . . and 100C sequentially in a desired number. Further, the electronic musical instrument can be made compact when a broad tone range is unnecessary, Furthermore, the electronic musical instrument can be easily transported when the musical instrument main unit and performance operating units 100B, 100B, . . . and 100C are disconnected.

Figure 11:
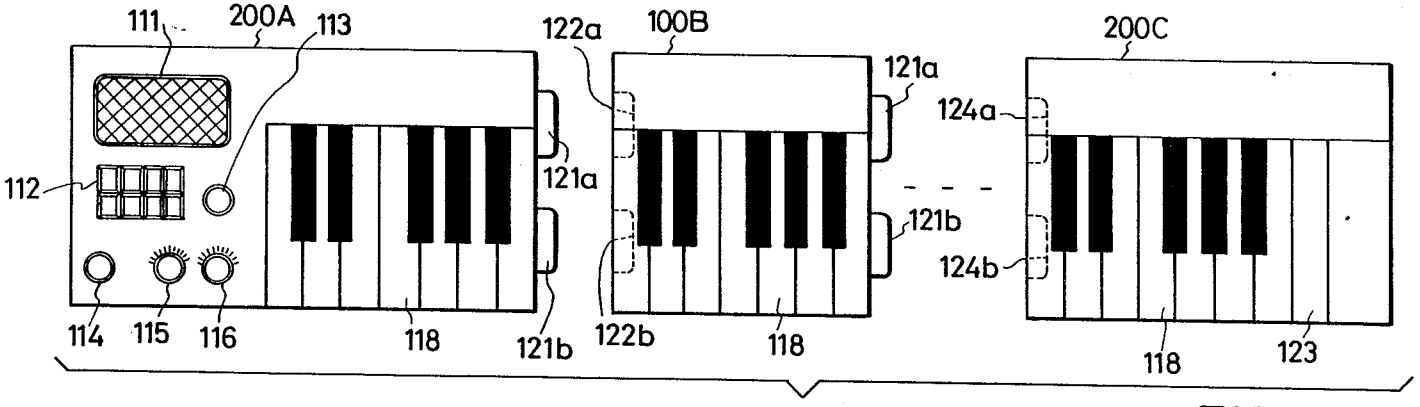
FIGS. 11 and 12 are sketches illustrating mutually different modifications of the embodiment shown in FIG. 9.
Figure 12:
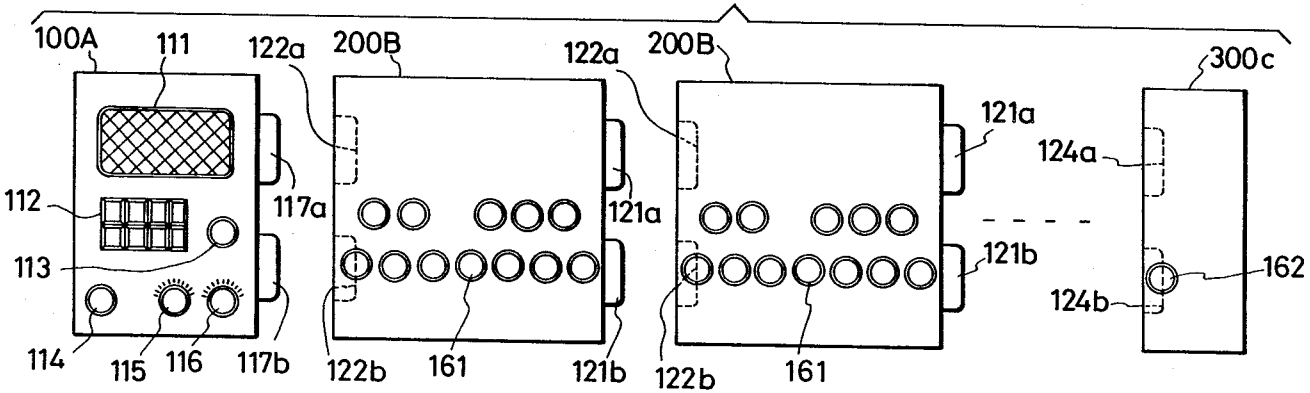

Though the musical instrument main unit is equipped with no keys in the Embodiment 3 described above, it is possible to equip the musical instrument main unit 100A with keys-118 covering an octave as shown in FIG. 11 or design a musical instrument main unit 200A as a combination of the musical instrument main unit 100A and the performance operating unit 100B. In this case, the musical instrument main unit 200A comprises an electrical circuit module including the electrical circuit modules 130A and 130B. Though the performance operating unit 100C is equipped with the key 123 for C-tone only in the Embodiment 3 described above, it is possible to add the key 123 for C-tone to any one of the performance operating units 100B or design a performance operating unit 200C as a combination of the performance operating units 100B and 100C. In this case, the performance operating unit 200C comprises an electric circuit module including the electric circuit modules 100B and 100C. Though pitches are designated by the keys 118 and 123 in the Embodiment 3 described above, it is possible to designate pitches by push button 161 and 162 as shown in FIG. 12. Though the performance operating unit 100B is equipped with the keys 118 covering an octave in the Embodiment 3 described above, it is possible to increase or decrease the number of the keys so as to cover a tone range wider or narrower than an octave. Moreover, though each of the performance operating units 100B, 100B, . . . and 100C is so designed as to transfer operation information on each of the keys 118 and 123 as parallel signals of 12 bits, it is possible to transfer this information in a time division mode (for example, as serial signals of 1 bit) to the musical instrument main unit.

What is claimed is:

1. An electronic musical instrument comprising at least three component blocks mechanically and electrically connectable in succession, each having tone elements control means and at least one of said blocks further having a tone signal generating means, and said plural number of blocks being connected in succession to change either one of a time range of a tone or a tone range of the tones generated therefrom.

2. An electronic musical instrument comprising a plural number of mechanically and electrically connectable component blocks connected in succession, each block being equipped with:

a tone producing means, a first connector and a second connector allowing mechanical and electrical connection to the other blocks, input means arranged on said first connector for inputting signals for starting production of tones of the block, and output means arranged on said second connector for outputting a signal indicating termination of the tone signal generation of the block.

3. An electronic musical instrument according to claim 2 wherein each of said blocks comprises direction detecting means to detect a direction of the connected block and the elements of tones to be produced are controlled by an output from said direction detecting means.

4. An electronic musical instrument according to claim 3 wherein said direction detecting means controls durations of tones to be produced by outputs of the connected block.

5. An electronic musical instrument according to claim 2 wherein each of said blocks further comprises storage means for storing performance data including a plural number of musical notes and tone signal generating means driven by an output from said storage means.

6. An electronic musical instrument according to claim 2 wherein at least one of said plural number of blocks comprises a rest note for stopping generation of musical note for a predetermined time.

7. An electronic musical instrument according to claim 2 wherein at least one of said plural number of blocks comprises tone signal generating means driven by the signal from said input means, and mixing means for mixing the tone signal inputted from a preceding block through said input means with the tone signal from said tone signal generating means and transferring the mixed signal to a subsequent block.

8. An electronic musical instrument according to claim 2 wherein one of said plural number of blocks further comprises means for converting the tone signal into a tone.

9. An electronic musical instrument according to claim 8 wherein said one of the plural number of blocks further comprises a power source for supplying driving power to the blocks and a clock pulse generating means for supplying clock pulses to the blocks.

10. An electronic musical instrument according to claim 2 further comprising at least one branching connector for parallelly connecting some of said plural number of blocks.

11. An electronic musical instrument according to claim 2 further comprising connectors for parallelly connecting said plural number of blocks in a folded form.

12. An electronic musical instrument comprising a tone generating block for generating tone signals, a plural number of performance operating blocks having a plural number of pitch designating manipulators and consecutively connectable to said tone generating block, means for determining a tone range for each of said plural number of blocks depending on connected conditions, means for designating a predetermined pitch in said determined tone range when said each of plural number of manipulators is operated, and means for producing a musical tone of said designated pitch.

13. An electronic musical instrument comprising a tone generating block for generating tone signals, and a plural number of performance operating blocks having a plural number of pitch designating manipulators and connectable in succession to said tone block to make up a series wherein:

said tone generating block comprises:

first output means for outputting position indicating signals for indicating the positions of an operating block in said series, said operating block whose position in indicated by said position indicating signal sending a detected signal representative of the pitch of an operated pitch manipulator in response to said position indicating signal;

first input means for inputting the detected signals representing an operated pitch designating manipulator sent from said operating block whose position is indicated by said position indicating signal; and tone generating means for generating a tone having a pitch corresponding to said detected signal; and each of said plural number of performance operating blocks comprises:

second input means capable of being connected to one of said first output means and previous stages of the performance operating block in said series for inputting the position indicating signals outputted from said tone generating block;

position detecting means for detecting whether or not the connected positions of said performance operating block are as indicated by said position indicating signal;

second output means capable of being connected to subsequent stages of the performance operating block in said series for outputting said position indicating signals for detecting in said subsequent stages that the connected positions of the performance operating blocks are as indicated by said position indicating signal;

manipulator detecting means for detecting operation of said pitch designating manipulator;

third input means capable of being connected to said subsequent stages for inputting said detected signals; and third output means capable of being connected to one of said first input means and said previous stages for outputting the detected signals representing operated pitch designating manipulators of the operating block detected by said manipulator detecting means when said position indicating signal indicates the position of the operating block, and for outputting said detected signal inputted from said subsequent stages through third input means when said position indicating signal signal does not indicate the position of the operating block.

14. An electronic musical instrument according to claim 13 wherein said first output means and said first input means are connected fixedly to said second input means and said third output means respectively, whereby said tone generating block includes one of said performance operating blocks.

15. An electronic musical instrument according to claim 13 wherein a plural number of pitch designating manipulators of said performance operating block are designed as key switches covering an octave.

16. An electronic musical instrument according to claim 13 wherein said plural number of pitch designating manipulators of said performance operating block are designed as button switches in a number of one octave.

* * * * *